United States Patent [19]

Sloma et al.

[11] Patent Number: 4,471,905

[45] Date of Patent: Sep. 18, 1984

[54] FARE COLLECTION APPARATUS HAVING IMPROVED SECURITY

[75] Inventors: Richard S. Sloma, Park Ridge; Joseph A. Salvato, Arlington Heights, both of Ill.

[73] Assignee: General Signal Corporation, Stamford, Conn.

[21] Appl. No.: 434,605

[22] Filed: Oct. 15, 1982

[51] Int. Cl.[3] ..... G07B 15/00

[52] U.S. Cl. ..... 232/12; 232/15

[58] Field of Search ..... 232/7, 11, 12, 15, 16

[56] References Cited

U.S. PATENT DOCUMENTS

| | | | |
|---|---|---|---|
| Re. 28,307 | 1/1975 | Dominick et al. | 232/7 |
| Re. 28,308 | 1/1975 | Dominick et al. | 232/16 |
| 3,795,417 | 3/1974 | Cohen | 232/15 X |
| 3,926,019 | 12/1975 | Mazeika | 232/12 X |
| 3,944,976 | 3/1976 | FRX | 304/146.2 |
| 3,966,116 | 6/1976 | Dominick et al. | 232/7 |
| 4,201,333 | 5/1980 | Oslin et al. | 232/7 |
| 4,380,316 | 4/1983 | Glinka et al. | 232/16 |

*Primary Examiner*—Robert P. Swiatek

*Attorney, Agent, or Firm*—McDougall, Hersh & Scott

[57] ABSTRACT

A farebox for receiving currency includes a housing having a deposit section, a cashbox for holding the currency, and a recess in the housing for removably receiving the cashbox. A blocking mechanism defined by the cashbox closes an entrance to the cashbox to prevent access to the currency contained therein. A lock holds the blocking mechanism in a blocking position and a lock operating mechanism unlocks the lock to enable movement of the blocking mechanism from the blocking position when the cashbox is positioned within the recess. This invention is characterized by a first digital circuit for generating a first digital code and a second digital circuit for sensing if the first code is the same as the second code stored therein. One of the circuits is mounted in the housing and the other mounted in the cashbox. An electrical contact mechanism connects the circuits when the cashbox is received within the recess. A motor is coupled to the blocking mechanism and is controlled by a control mechanism which is responsive to the second circuit sensing that the first and second codes are the same. The motor causing the blocking mechanism to be moved from the blocking position to permit access to the cashbox.

8 Claims, 12 Drawing Figures

FARE COLLECTION APPARATUS HAVING IMPROVED SECURITY

BACKGROUND OF THE INVENTION

This invention relates to a security apparatus for receiving, storing, and transferring coins, bills, and tokens deposited therein. This invention is especially suited for use in a fare collection apparatus commonly referred to as a "farebox" in a mass transit system.

Various problems arise in the case of large transit systems where fares are collected on many individual vehicles and at many different stations. Although robbery is a serious concern, pilferage on the part of persons handling and transferring the collected revenue commonly provides an even greater problem. It is the periodic or repetitious nature of the pilferage of revenues which magnifies such a problem. For example, if employees of a transit system find a way to violate the security system without physically damaging the fare collection apparatus, a percentage of the revenues collected can be repetitively stolen from a fare collection apparatus. Because such pilferage may be difficult to detect, large sums may be lost before the security problem is discovered.

It is well known to use a mechanical lock on a collection apparatus. A key is required to open the locked apparatus so that the accumulated revenues can be removed. The breakage of such keys is common in large mass transit systems where a key is used to frequently unlock a great number of fareboxes. Since torque is typically transmitted through the key to lock and unlock various mechanical security devices in the farebox, the key wears out relatively rapidly and must be periodically replaced.

PRIOR ART

In Oslin U.S. Pat. No. 4,201,333, a farebox employs a removable cashbox for receiving and holding fares. The cashbox itself acts as a security mechanism. In this cashbox, a mechanical lock operated by separate key and a mechanical interlock operated by key mechanism mounted to the housing of the farebox are utilized to provide security. Torque is transmitted via the key to lock and unlock security devices.

Other systems directed towards providing a secure apparatus for valuables are described in Dominick, et al U.S. Pat. Nos. RE 28,307, RE 28,308, and 3,966,116.

In patent application Ser. No. 283,228, assigned to the assignee of the present invention, an electronic interlock for a cash collection receptacle is described. A receiver responsive only to a predetermined electronic signal is mounted to the receptacle and a transmitter for generating said signal is mounted to a removable vault. Electrical connectors mounted to the removable vault and the receptacle permit the transmission of the coded electronic signal from the vault to the receptacle.

An electronic lock is described in France U.S. Pat. No. 3,994,976 wherein a digital code is stored in an electronic key which mates with an electronic lock. The code is transmitted from the key to the lock. The lock is opened if the code transmitted by the key corresponds to the code stored in the lock.

SUMMARY OF THE INVENTION

This invention generally relates to a fare collection apparatus for receiving, storing, and transferring fares such as coins, bills, or tokens in a mass transmit system.

It is an object of this invention to solve the maintenance problems associated with mechanical keys in a fare collection apparatus.

Another object of this invention is to provide an electric motor for locking and unlocking a removable cashbox received therein by a farebox.

A further object of this invention is to provide an improved security system for a farebox wherein an electronic key and an electronic lock utilize coded digital data for increased security.

A yet further object of this invention is to provide a collection apparatus with a coded card reader which permits the cashbox to be removed from the collection apparatus only upon the recognition of a predetermined code.

An additional object of the present invention is to provide an electrically controlled locking mechanism for preventing unauthorized access to the cashbox.

It is contemplated that the present invention will be incorporated in a fare collection apparatus which includes a housing having a deposit section for receiving bills and coins. The housing also defines a compartment for removably receiving a cashbox utilized to hold the currency. At least one aperture is provided on the cashbox for receiving the currency. A blocking plate or the like is utilized to block access to the aperture.

A lock means is provided in the cashbox for releasably locking the blocking plate in a closed position. An annular projection extends from the cashbox and is connected to a shaft which is coupled to the blocking plate to open and close same. The lock means is engagable with the shaft to prevent rotation of same in the locked position.

A first digital circuit means mounted in the farebox communicates with a second digital circuit means mounted in the cashbox by means of engaging electrical contacts mounted to the cashbox and farebox. Upon the receipt by the second data circuit means of a predetermined digital code generated by the first circuit means, the locking structure in the cashbox is released permitting the shaft to be rotated thereby opening the blocking plate to provide access to the cashbox. The annular projection connected to the shaft from the cashbox is coupled to a drive mechanism that is connected to an electric motor. Upon the receipt by the first circuit means of another predetermined digital code generated by the second digital circuit means, the electric motor is activated to rotate the shaft in the cashbox thereby opening the blocking plate. Additional mechanical interlock means locks the cashbox to the farebox (collection apparatus) when the blocking plate is open to prevent the removal of the cashbox in the open position.

A coded card reader mounted to the collection apparatus is coupled to the first circuit means to operate the electric motor in a direction so as to close the blocking plate in the cashbox upon the recognition by the reader of a predetermined code. Thus, by inserting a properly coded card into the card reader, the electric motor causes the blocking plate on the cashbox to close thereby locking the cashbox in a closed position. This simultaneously disables the mechanical interlocks between the cashbox and collection apparatus allowing the cashbox to be removed from the farebox.

DETAILED DESCRIPTION

Figure 1:
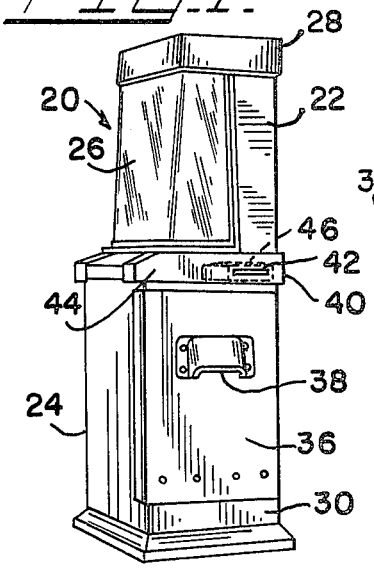
FIG. 1 is a perspective view of a fare collection apparatus incorporating the features of this invention.

Referring to FIG. 1, a fare collection apparatus 20 includes an upper housing section 22 and a lower housing section 24. The upper housing section may include a window 26 which permits currency deposited in suitable deposit openings in the top 28 of the apparatus to be viewed for verification of the proper fare.

Figure 8:
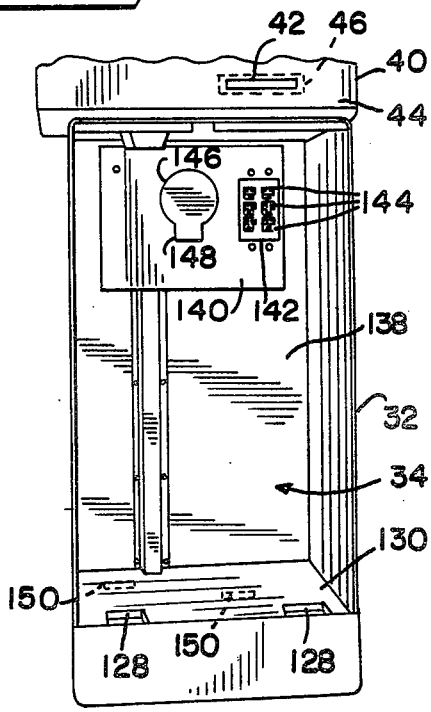
FIG. 8 is a fragmentary perspective view of a chassis in the fare collection apparatus which provides a compartment for receiving the cashbox.

The lower section 24 includes an access opening in the wall 30 in which an inner chassis 32 is mounted (see FIG. 8). The chassis includes a large recessed area of compartment 34 for receiving a revenue collection box 36 commonly referred to as a cashbox. A handle 38 is provided on the face of the cashbox whereby it can be inserted and removed from compartment 34.

A middle section 40 of the fare collection apparatus includes a slot 42 in wall 44 to permit a coded card to be inserted therein so as to communicate with a card reading mechanism 46 mounted in the center section.

Referring to FIGS. 2-7, the cashbox 36 may incude internal partitions 48 and 50. These divide the box into a first compartment 52 for holding coins and a second compartment 54 for holding bills.

A rotatable shaft 56 is journaled at the rear wall 58 and front wall 60 of the cashbox by conventional bearing means. An annular collar 62 projects rearwardly from wall 58 and is coupled to shaft 56. The annular collar includes a radially projecting tang 64 (see FIG. 5).

A larger diameter collar 66 is fixedly mounted to shaft 56 inside the cashbox. This collar includes an annular channel 68 which extends approximately 180 degrees about the circumference of the collar. At one end of the channel, a recess 70 is provided and is dimensioned to receive a tooth 72 which projects from a pivotally mounted arm assembly 74. A solenoid 76 is connected to arm assembly 74. The solenoid is biased by means of spring 78 such that tooth 72 is urged to engage channel 68 and to engage recess 70 when the shaft 56 is rotated such that the recess 70 and tooth 72 are in alignment. When the solenoid is energized, it causes the arm assembly 74 and hence tooth 72 to pivot generally away from collar 66 bringing the tooth from engagement with the recess 70. The arm assembly 74 and solenoid 76 are mounted to wall 48 by means of a mounting bracket 80. Thus, this arrangement provides a means for locking the shaft 56 against rotation when the tooth is engaged within the recess 70.

Figure 2:
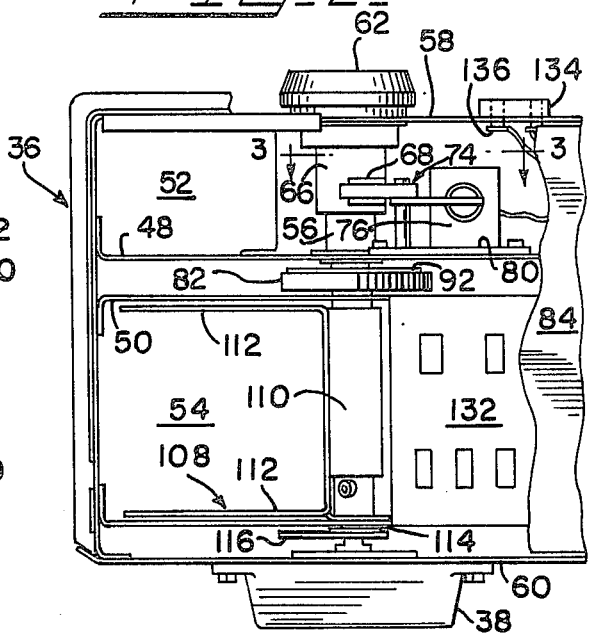
FIG. 2 is a top view of an embodiment of a cashbox according to the present invention with the top partially cut away.
Figure 4:
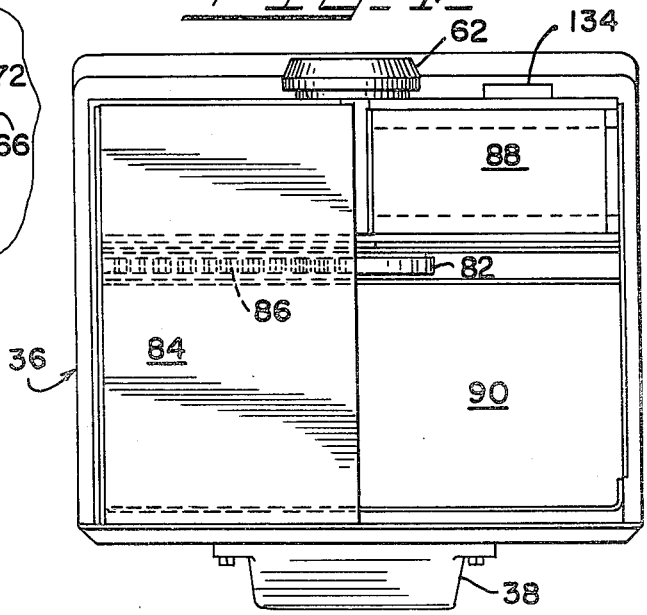
FIG. 4 is a top plan view of the cashbox.
Figure 5:
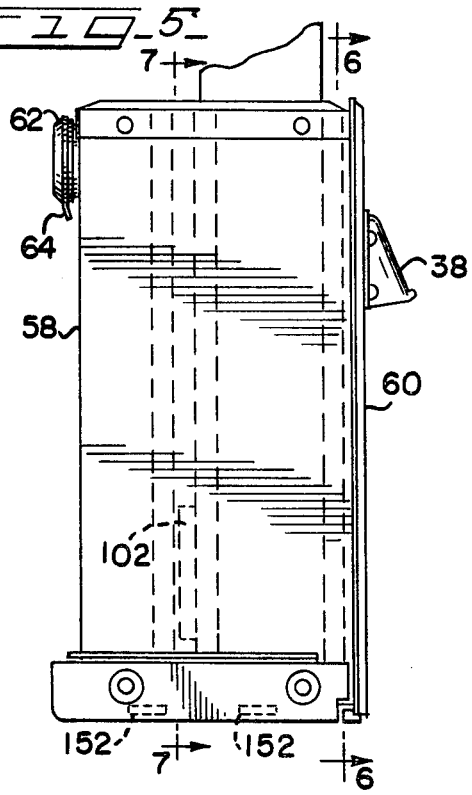
FIG. 5 is a side elevational view of the cashbox.
Figure 6:
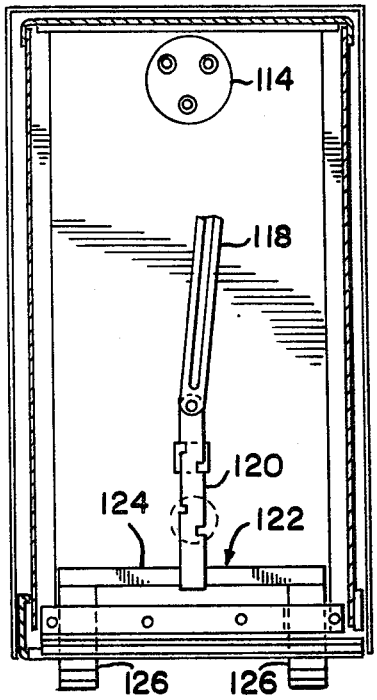
FIG. 6 is a vertical cross sectional view taken along line 6—6 of FIG. 5.
Figure 7:
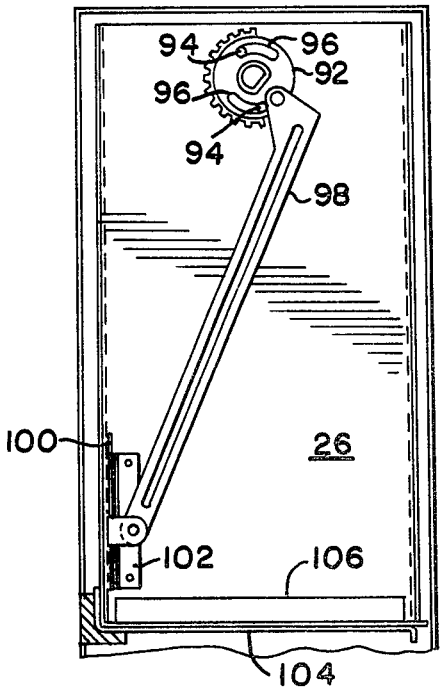
FIG. 7 is a fragmentary, vertical cross sectional view taken along line 7—7 of FIG. 5.

A gear 82 is mounted to shaft 56 so as to rotate with same. A blocking plate 84 carries a rack 86 which meshes with this gear. Thus, the blocking plate is adapted to be moved back and forth by the gear between a blocking position as shown in FIG. 4 and a non-blocking position as indicated in FIG. 2. Cover plates 88 and 90 are mounted so as to permit blocking plate 84 to slide above same in the non-blocking position. These cover plates terminate approximately adjacent shaft 56 and enclose approximately one-half of the top area of the cashbox.

A disc 92 is attached to gear 82 by means of pins 94 which are received in slots 96 in the disc. This arrangement defines a lost motion assembly which restricts the motion imparted to a bottom door locking arm 98 that is attached at one end to the disc. The other end of the locking arm carries a vertically moveable bar 100 which is guided by an angle member 102 that is mounted to partition wall 26. The movement of the disc operates to raise and lower the bar 100.

The bottom wall of the cashbox consists of a horizontally extending plate 104 and an intermediate right angle member 106. The bottom plate includes two opposite edges which are slidably mounted in grooves defined by the front and rear walls of the cashbox. When the bar 100 is lowered, the bar serves to abut one end of member 106 thereby latching the bottom wall assembly against sliding movement. The bar is lowered into the latching position whenever the cashbox is separated from the collection apparatus. Although the bottom wall assembly is released while the cashbox is seated within chassis 32 of the lower housing section 24, the bottom wall cannot be moved since the side walls of the chassis prevent this. The purpose of having a bottom wall assembly which can be moved is to permit the stored revenue in the cashbox to be discharged into a separate assembly.

The shaft 56 also supports a rotatable chute assembly 108. This assembly includes a cylindrical portion 110 which is mounted to a shaft 56 so that walls 112 are rotated outwardly from compartment 54 in the currency receiving position. This chute assembly provides a guide means for guiding bills into chamber 54 from a passage way in the upper section 22 of the collection apparatus.

A disc 114 is mounted to shaft 56 and has an arm 116 mounted thereto which is connected to a linking arm 118. The linking arm is also connected to a vertical member 120 which forms part of a latching assembly 122. The latching assembly includes a cross bar 124 and vertically extendable feet 126. The feet are located so as to be received within slots 128 defined in the bottom 130 of chassis 32 as shown in FIG. 8. These feet, when lowered, engage the slots 128 to prevent the cashbox from being removed from the collection apparatus. These feet are lowered into engagement with the slots when the blocking plate 84 is in the non-blocking position. Thus, these feet prevent the cashbox from being removed whenever access to the compartments in the cashbox is possible.

A more detailed explanation of a generally suitable cashbox may be had by referring to Oslin U.S. Pat. No. 4,201,333 which is incorporated herein by reference.

Referring in particular to FIG. 2, a printed circuit board 132 containing cashbox circuit elements may be mounted generally below cover plate 90 in the cashbox. The circuit board is connected to solenoid 76. Other connections to the printed circuit board are made by means of a connector block 134 mounted to the rear wall 58 of the cashbox. The connector block includes a plurality of electrical contacts 136.

Referring to FIG. 8, a panel 140 is mounted to the rear wall 138 of the chassis 32. A connector block 142 containing a plurality of contacts 144 is mounted to this panel at a location such that contacts 144 engage corresponding contacts 136 of connector block 134 on the cashbox when the latter is seated within chamber 34. The panel defines a cut out annular portion 146 for receiving annular projecting collar 62 of the cashbox and a notch portion 148 for receiving tang 64. It will be appreciated that this arrangement provides a locking mechanism when tang 64 is rotated away from notch portion 148.

Magnetically operable switches 150 are located at selected positions below floor 130 of the chassis 32. Permanent magnets 152 (see FIG. 5) are mounted to the bottom of the cashbox to align with the respective switches 150 when the cashbox is properly seated within chamber 34 thereby activating the switches. It will be appreciated that bottom 130 is made of a material which will permit magnetic communication between the magnets and switches.

Figure 9:
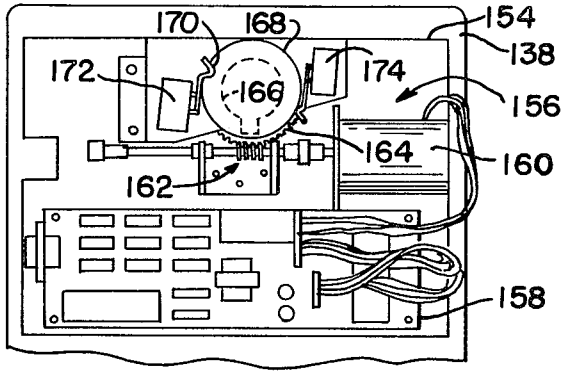
FIG. 9 is a fragmentary view of the rear wall of the chassis shown in FIG. 8.

In FIG. 9, a mounting panel 154 is mounted to the rear face of wall 138 of chassis 32 generally opposite panel 140. A motor assembly 156 and a printed circuit board 158 containing the farebox circuit elements are mounted to panel 154. The motor assembly includes an electric motor 160, a worm drive assembly 162, and a gear 164. The gear is coupled to an engagement member 166 which drivingly engages annular collar 62 and tang 64 when the cashbox is received in compartment 34. A cam 168 is mounted to gear 164 and includes a recess 170. Conventional spring loaded microswitches 172 and 174 each include an arm biased against cam 168 to sense when recess 170 aligns with arm. These switches function as limit switches which stop the motor such that the rotation of shaft 56 of the cashbox is limited to approximately 180 degrees of travel.

Figure 10:
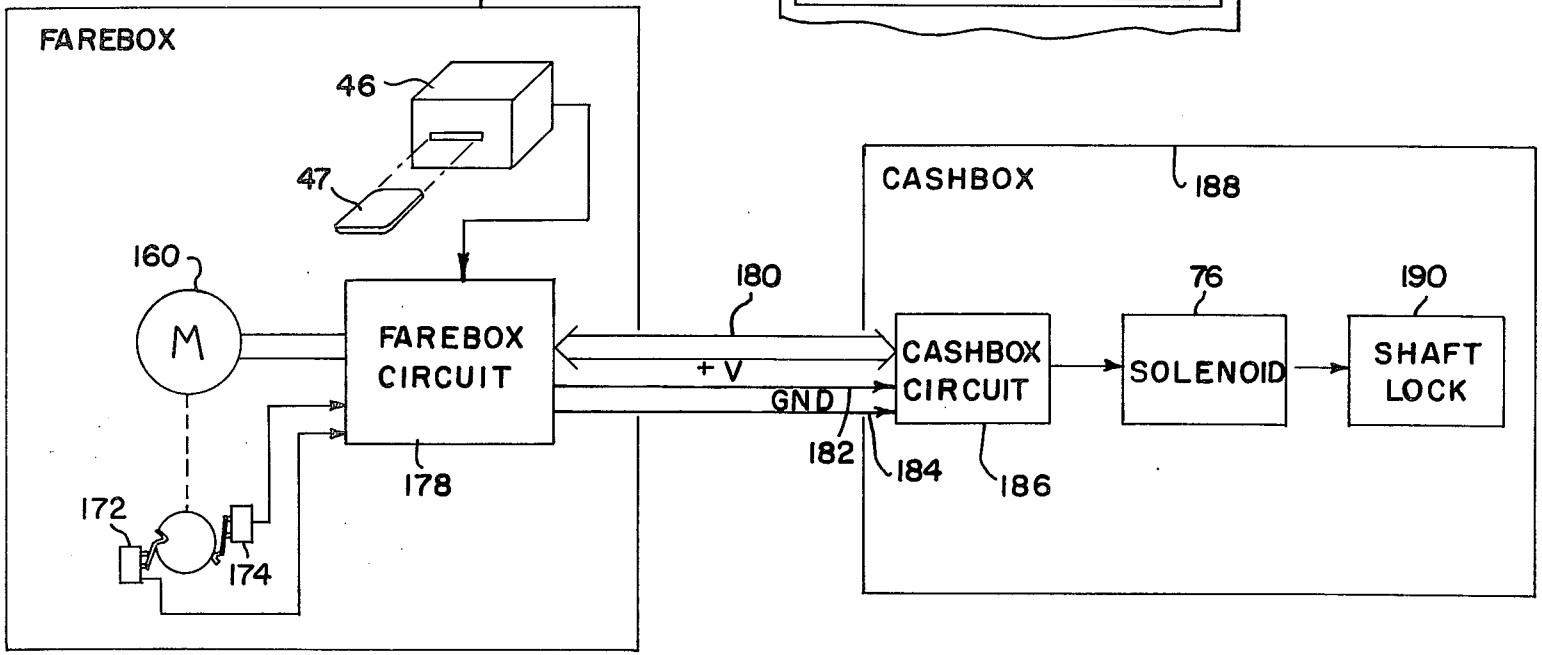
FIG. 10 is a diagramatic illustration of the embodiment of the present invention.

FIG. 10 is a general block diagram illustrating the electronic security system of the present invention. The fare collection apparatus or farebox as represented by numeral 176 includes a farebox circuit 178 having a motor control portion for activating motor 160 and for stopping the motor in response to limit switches 172 and 174. A card reader 46, which may consist of a magnetic card reader for responding to a properly encoded magnetic card 47, provides an input to the motor control portion of farebox circuit 178. The insertion of a properly encoded card 47 into reader 46 causes power to be applied to the motor. A coded card 47 is utilized to activate the motor so as to return the cashbox to a locked or non-accessible position so that same can be removed from the farebox.

Data communication lines 180, DC supply voltage line 182 and a ground line 184 interconnect the farebox circuit with the cashbox circuit 186 contained within the cashbox represented by numeral 188. The farebox circuit applies power to the motor 160 causing the cashbox to assume its accessible (currency receiving) position only upon the proper recognition by the farebox circuit that an authorized cashbox has been inserted therein. At least one of the farebox and cashbox circuits provides a predetermined coded signal to the other as part of the security system. Preferably, both the farebox and the cashbox circuits each provide a coded signal to the other for a higher level of security.

Figure 3:
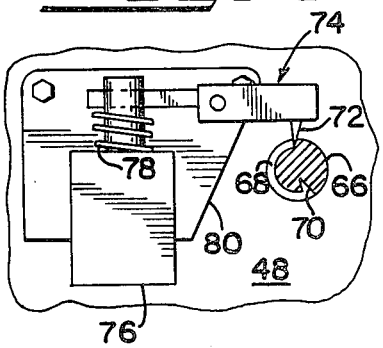
FIG. 3 is a partial cross sectional view taken about line 3—3 of FIG. 2.

The cashbox circuit 186 provides an output to solenoid 76 which controls a mechanical shaft lock mechanism 190 such as generally illustrated in FIG. 3. Upon the recognition of the coded signal or signals corresponding to the predetermined code or codes, the cashbox circuit energizes solenoid 76 which in turn will release the shaft lock mechanism 190 permitting shaft 56 to be rotated by motor 160. The farebox circuit then applies power to the motor causing same to rotate shaft 56 such that the cashbox is opened to receive currency. To remove the cashbox, a card 47 must be utilized as described above.

Figure 11:
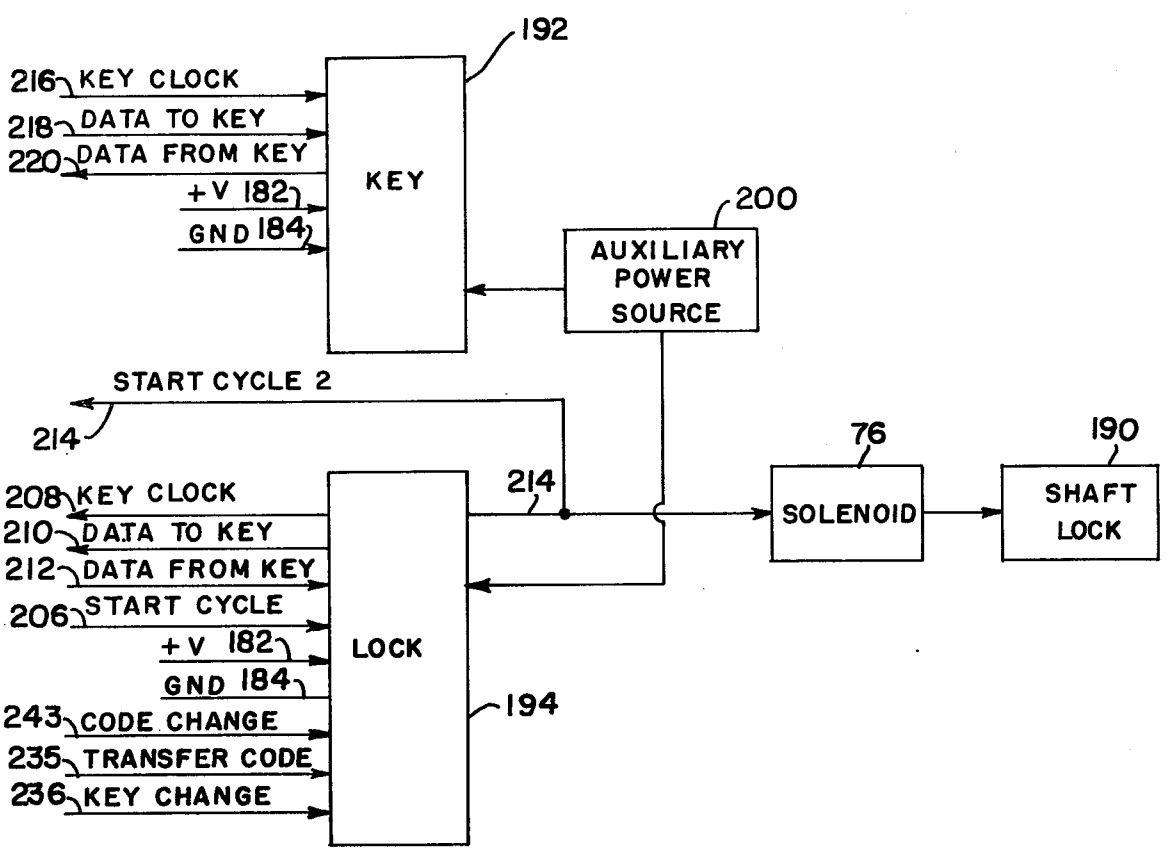
FIG. 11 is a block diagram illustrating an embodiment of the cashbox circuit elements.
Figure 12:
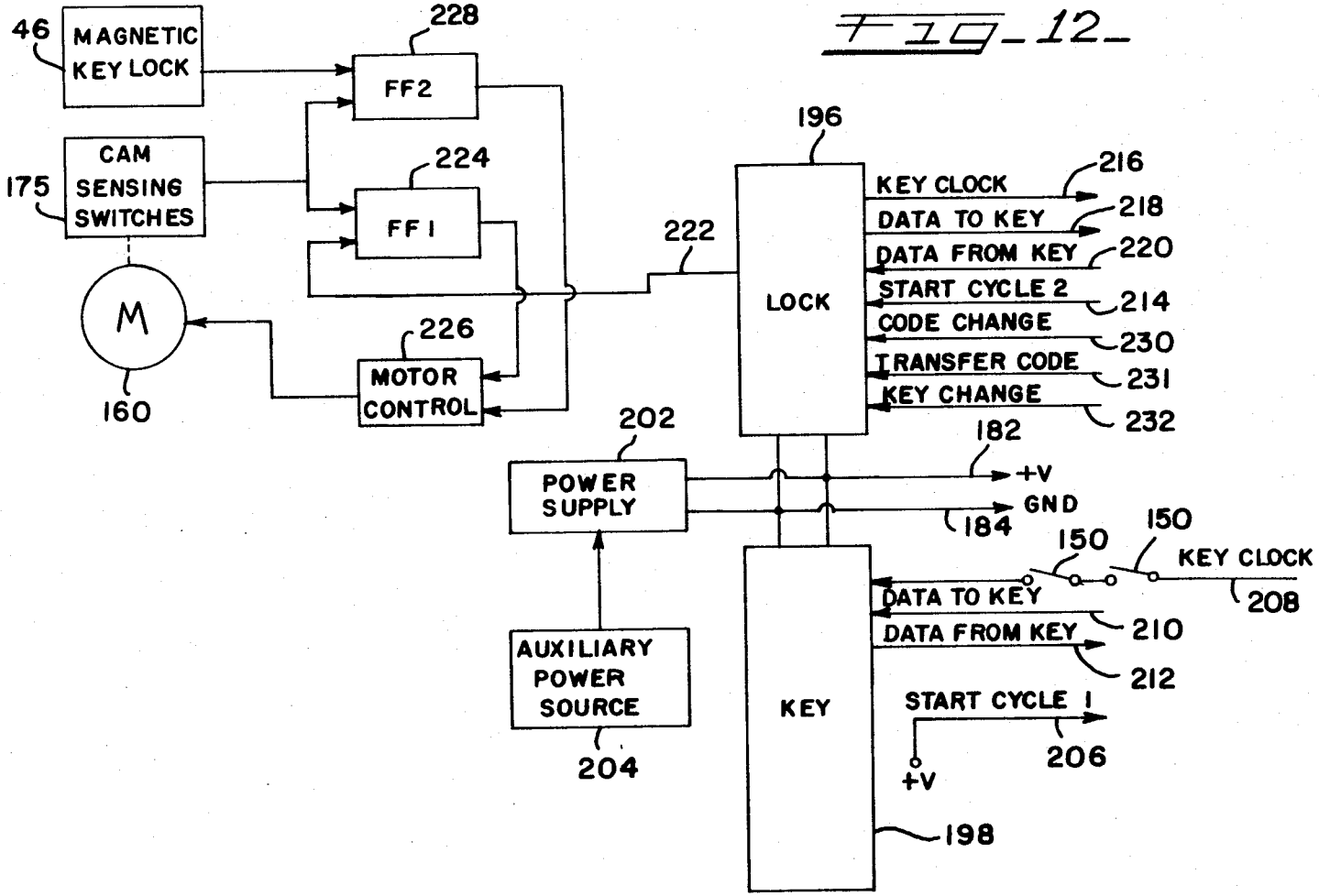
FIG. 12 is a block diagram illustrating an embodiment of the farebox circuit elements.

FIGS. 11 and 12 are expanded block diagrams of the cashbox diagram 188 and the farebox diagram 176, respectively. By placing the left edge of FIG. 11 adjacent the right edge of FIG. 12 it will be apparent that the various lines associated with electronic key 192 and electronic lock 194 in FIG. 11 correspond with similarly referenced lines in FIG. 12 which are associated with electronic lock 196 and electronic key 198. The general operation of these electronic keys and electronic locks are provided below. A more complete understanding of the electronic keys and locks may be had by referring to France U.S. Pat. No. 3,944,976 which is incorporated herein by reference.

In the cashbox system as shown in FIG. 11, an auxiliary power source 200, which may include a battery, ensures a constant source of DC voltage to electronic key 192 and electronic lock 194 so that a predetermined code stored in the memory of each will be retained when the cashbox is removed from the farebox. Normal operating power is supplied by lines 182 and 184 from power supply 202 in the farebox when the cashbox is received therein. The primary source of energy to power supply 202 may, for example, be derived from an electrical system of a vehicle in which the farebox is mounted. An auxiliary power source 204 supplies power should the power from the vehicle be interrupted.

Upon the insertion of the cashbox into the farebox, start cycle 1 line 206 provides a logic 1 to the electronic lock 194 thereby initiating a data exchange between electronic key 198 and electronic lock 194. It will be appreciated that magnetically operable switches 150, which may be connected in series with the key clock line 208, were closed upon the insertion of the cashbox into the farebox thereby completing the continuity of the key clock line 208 between key 198 and lock 194. If switches 150 are not closed, the key clock line 208 would have remained open preventing the exchange of data between the key and lock. This would prevent the release of the shaft lock mechanism 190 and the cashbox would remain secure. Thus, the switches and magnets cooperate to form a concealed interlock.

Electronic key 198 and lock 194 exchange data by means of lines 210 and 212. Lock 194 compares the data received from key 198 and if this data, which represents a predetermined security code, corresponds with a previously stored code (data) within lock 194, lock 194 causes its output line 214 to change state. This energizes solenoid 76 and releases the shaft lock mechanism 190 which permits the shaft 56 of the cashbox to be rotated.

The output line 214 is connected to lock 196 and initiates the start of cycle 2. The key clock line 216, the data to key line 218, and the data from key line 220 interconnect electronic lock 196 with electronic key 192. If the data received by lock 196 from key 192 corresponds to a predetermined security code stored in the lock, the output line 222 of the lock will change state setting flip-flop 224. The output of flip-flop 224 will in turn cause motor control circuit 226, which may include relays, to apply power to motor 160 causing shaft 56 to rotate causing the blocking plate 84 of the cashbox to move from a blocking to a non-blocking position. This, of course, causes the cashbox to be locked within compartment 34 as previously explained because of the mechanical interlocks. Flip-flop 224 is reset by the cam sensing switches 175 (consisting of switches 172 and 174) to stop motor 160. Thus, the cashbox is locked inside the farebox and has been automatically opened by means of motor 160 from a non-accessible position to a position ready to receive currency.

To remove the cashbox from the farebox, a properly encoded card 47 is inserted into a programmed card reader 46 such as a conventional magnetic key lock. If the card contains the correct code, the output of the magnetic key lock will cause flip-flop 228 to be set which in turn causes motor control 226 to apply power to motor 160. It will be appreciated that motor control circuit 226 applies power, i.e. current, in a reverse polarity to motor 160 when activated by flip-flop 228 as compared to when it is operated by flip-flop 224. This enables the motor to rotate shaft 56 back and forth. Thus, shaft 56 is rotated in a direction causing blocking plate 84 to move from an accessible position to a blocking position. Flip-flop 228 is reset by cam switches 175 to stop the motor when the blocking plate is in its final blocking position. As previously explained, this removes the mechanical interlocks previously locking the cashbox to the farebox thereby permitting the cashbox to be removed. Therefore, the cashbox as removed will have blocking plate 84 blocking access to the top of the box and bottom plate 104 locked in position to block access from the bottom of the box.

The predetermined security code associated with key 192 and lock 196 may be a different code from that associated with lock 194 and key 198. Thus, the present invention permits two independent codes to be utilized to provide a high level of security. Furthermore, requiring a proper security code recognition by one of the electronic key/lock pairs prior to a data exchange between the other pair further enhances the security of the system.

The electronic key/lock pairs can be reprogrammed to contain a new digital security code from an external data source by means of lines 230–232 and lines 234–236. The previously referenced France patent will provide a more detailed explanation as to the programming of digital codes in the electronic locks and keys.

Although an embodiment of the present invention has been described herein and illustrated in the drawings, the scope of the invention is defined by the claims appended hereto.

What is claimed is:

1. In a farebox for receiving currency including a housing having a deposit section, a box for holding the currency, a recess in the housing for removably receiving the box, entry means defined by the box for receiving the currency, blocking means for closing said entry means, lock means holding the blocking means in blocking position to prevent access to said box, and lock operating means for unlocking said lock means to enable movement of said blocking means from the blocking position when the box is positioned within said recess, the improvement comprising a first digital circuit means for generating a first digital code, a second digital circuit means for sensing if said first code is the same as a second code stored therein, one of said first and second circuit means mounted in said housing and the other mounted in said box, and electrical contact means for connecting said one to said other when the box is received in said recess, a motor mounted in said housing, means for coupling said blocking means to said motor, said lock means comprising means for engaging the coupling means to prevent movement of the blocking means by said motor, and control means, responsive to said second circuit means sensing said first and second codes are the same, for operating same motor wherein said blocking means is moved from said blocking position to permit access to said entry means whereby currency is receivable by said box.

2. The farebox according to claim 1 further comprising a circuit initiating means which automatically causes said first digital circuit means to generate said first digital code in response to said box being received within said recess.

3. The farebox according to claim 1 further comprising a switch means, in circuit with said second digital circuit means, for preventing said first digital code from being sensed by said second digital means until said box is received within said recess, said switch means being separate from said electrical contact means.

4. The farebox according to claim 1 further comprising means mounted to said housing for receiving a card having a code disposed thereon and for sensing if said code on said card is the same as a predetermined code stored therein, and means, responsive to said card receiving means sensing said code of the card and said predetermined code are the same, for operating said motor wherein said blocking means is moved from a position permitting access to said entry means to said blocking position whereby said box is secured against access.

5. In a farebox for receiving currency including a housing having a deposit section, a box for holding the currency, a recess in the housing for removably receiving the box, entry means defined by the box for receiving the currency, blocking means for closing said entry means, lock means holding the blocking means in blocking position to prevent access to said box, and lock operating means for unlocking said lock means to enable movement of said blocking means from the blocking position when the box is positioned within said recess, the improvement comprising a first digital circuit means for generating a first digital code, a second digital circuit means for sensing if said first code is the same as a second code stored therein, one of said first and second circuit means mounted in said housing and the other mounted in said box, an electrical contact means for contacting said one to said other when the box is received in said recess, a motor mounted in said housing, means for coupling said second blocking means to said motor, said coupling means comprises a rotatable shaft mounted within said box, a gear means coupled to said shaft and coupled to said blocking means for controlling the movement of the latter, a collar means mounted to said shaft externally of said box, and a collar engaging means coupled to said motor for engaging said collar means when said box is received within said recess, and control means, responsive to said second circuit means sensing said first and second codes are the same, for operating said motor, said lock means comprises means for engaging said shaft to prevent the rotation of said shaft, and a solenoid operatively connected to said engaging means, said solenoid, when activated, causing said engaging means to release said shaft allowing the latter to be rotated.

6. The farebox according to claim 5 further comprising means, responsive to said second circuit means sensing said first and second codes are the same, for controlling the activation of said solenoid.

7. In a farebox for receiving currency including a housing having a deposit section, a box for holding the currency, a recess in the housing for removably receiving the box, entry means defined by the box for receiving the currency, blocking means for closing said entry means, lock means holding the blocking means in blocking position to prevent access to said box, and lock operating means for unlocking said lock means to enable movement of said blocking means from the blocking position when the box is positioned within said recess, the improvement comprising a first digital circuit means for generating a first digital code, a second digital circuit means for sensing if said first code is the same as a second code stored therein, one of said first and second circuit means mounted in said housing and the other mounted in said box, an electrical contact means for connecting said one to said other when the box is received in said recess, a motor mounted in said housing, means for coupling said second blocking means to said motor, and control means, responsive to said second circuit means sensing said first and second codes are the same, for operating said motor, a switch means, in circuit with said second digital circuit means, for preventing said first digital code from being sensed by said second digital means until said box is received within said recess, said switch means being separate from said electrical contact means, said switch means comprises at least one magnetically operable switch mounted to said housing, and a magnet mounted to said box such that said magnet will be in magnetic communication with said at least one magnetic switch when said box is received within said recess.

8. In a farebox for receiving currency including a housing having a deposit section, a box for holding the currency, a recess in the housing for removably receiving the box, entry means defined by the box for receiving the currency, blocking means for closing said entry means, lock means holding the blocking means in blocking position to prevent access to said box, and lock operating means for unlocking said lock means to enable movement of said blocking means from the blocking position when the box is positioned within said recess, the improvement comprising an electronic security system including a first circuit means for generating a first digital code, a second circuit means for sensing if said first code is the same as a second code stored in said second circuit means, a third circuit means for generating a third digital code, and a fourth circuit means for sensing if said third code is the same as a fourth code stored in said fourth circuit means, one of said first and second circuit means and one of said third and fourth circuit means being mounted in said housing and the other of said first and second circuit means and the other of said third and fourth circuit means being mounted in said box, an electrical contact means for connecting said ones to said others when the box is received in said recess, a motor mounted in said housing, means for coupling said blocking means to said motor, said lock operating means being responsive to said second circuit means sensing said first and second codes being the same, and control means, responsive to said fourth circuit means sensing said third and fourth codes are the same, for operating said motor wherein said blocking means is moved from said blocking position to permit access to said entry means whereby currency is receivable by said box.

* * * * *